United States Patent [19]

Fenzl

[11] Patent Number: 4,644,882

[45] Date of Patent: Feb. 24, 1987

[54] WORKPIECE GUIDE RAIL INCLUDING SEWING MATERIAL STRETCHING DEVICE

[75] Inventor: Horst Fenzl, Oerlinghausen, Fed. Rep. of Germany

[73] Assignee: Durkoppwerke GmbH, Fed. Rep. of Germany

[21] Appl. No.: 876,224

[22] Filed: Jun. 19, 1986

[30] Foreign Application Priority Data

Jun. 22, 1985 [DE] Fed. Rep. of Germany ..... 3522329

[51] Int. Cl.[4] ..... D05B 21/00

[52] U.S. Cl. ..... 112/121.26; 112/305

[58] Field of Search ..... 112/121.26, 121.27, 112/121.11, 121.12, 121.15, 305, 121.14

[56] References Cited

U.S. PATENT DOCUMENTS

| | | | |
|---|---|---|---|
| 2,150,527 | 3/1939 | Talmadge | 112/305 |
| 4,062,309 | 12/1977 | Pollmeier et al. | 112/121.26 X |
| 4,131,074 | 12/1978 | Riss | 112/121.14 |
| 4,258,637 | 3/1981 | Hannemann | 112/121.26 |
| 4,394,840 | 7/1983 | Diekmann et al. | 112/121.26 X |
| 4,462,321 | 7/1984 | Mall et al. | 112/121.26 X |

*Primary Examiner*—H. Hampton Hunter

*Attorney, Agent, or Firm*—Ostrolenk, Faber, Gerb & Soffen

[57] ABSTRACT

A workpiece guide rail for a sewing machine, and more particularly a guide rail which includes a sewing material stretching device for spreading out the workpiece along the course of a seam prior to sewing. The guide rail includes a frame and a plurality of holding elements movably mounted on the frame, each holding element having a lower surface adapted for gripping the workpiece. The holding elements are interlinked to form a chain, one end of the chain being fixed to the frame, and an actuator is provided on the frame for pulling the other end of the chain for separating the holding elements in order to spread out the workpiece.

18 Claims, 6 Drawing Figures

WORKPIECE GUIDE RAIL INCLUDING SEWING MATERIAL STRETCHING DEVICE

BACKGROUND OF THE INVENTION

The present invention relates to a workpiece guide rail for a sewing machine, and more particularly to a guide rail which includes a sewing material stretching device for spreading out the material of the workpiece along the course of a seam prior to sewing.

In a known workpiece guide rail, disclosed in Federal Republic of Germany Pat. No. 20 22 735, the base of the guide rail is divided into short sections, each with spring action. Narrow leaf springs arranged alongside of each other are provided on its bottom, as a result of which the bottom of the workpiece guide rail can adapt itself to an accumulation of material in the region of the seam and also can cover locations directly adjacent the accumulation of material. This known workpiece guide rail, however, does not make it possible for the workpiece to be stretched in the region of the intended course of the seam prior to the sewing.

Accordingly, an important object of the present invention is to provide a guide rail with which it is possible, before sewing, to automatically elongate the workpiece which is to be sewn to a predetermined extent.

To carry out this and other objects, the invention includes a workpiece guide rail for a sewing machine for guiding a workpiece past a stitch formation point to determine the course of a seam, comprising a frame and a plurality of holding elements movably mounted on the bottom of the frame. Each holding element has a bottom surface adapted for gripping the workpiece. Means are provided for temporarily increasing a spacing between the holding elements by a predetermined amount in order to stretch the workpiece, and decreasing the spacing between the holding elements to their previous spacing in order to allow the workpiece to return to its previous dimensions. According to another aspect, the invention comprises means for interlinking the holding elements, and means for retaining each holding element movably mounted on the frame.

With the guide rail of the invention it is possible to sew multi-layer workpieces smoothly and free of wrinkles, by stretching the workpiece and thereby ensuring that for each stitch there is used a controlled amount of thread. Thus, a taut, wrinkle-free seam remains after sewing, when the workpiece has again resumed its original length.

BRIEF DESCRIPTION OF THE DRAWINGS

Other objects, features and advantages of the invention will be seen in the following detailed description of preferred embodiments thereof, with reference to the drawings, in which.

DETAILED DESCRIPTION OF PREFERRED EMBODIMENTS

Figure 1:
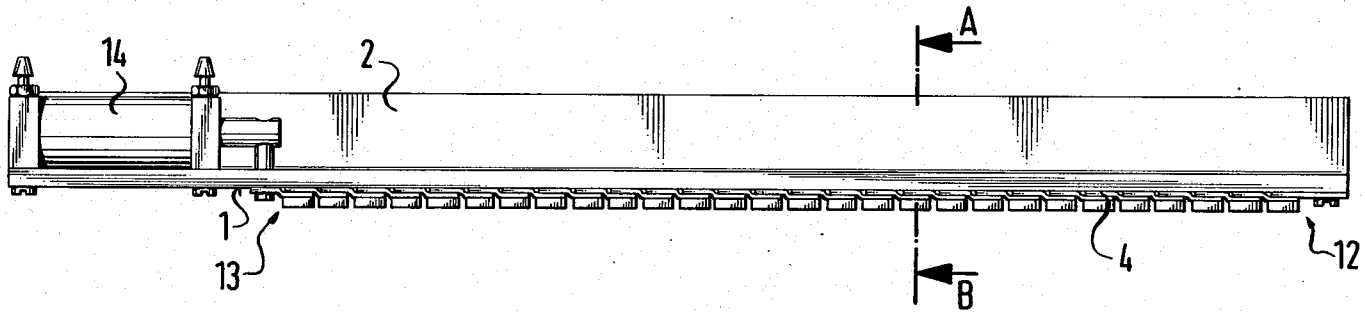
FIG. 1 is a front view of a guide rail according to an embodiment of the invention, having a sewing-material stretching device provided on its bottom.
Figure 5:
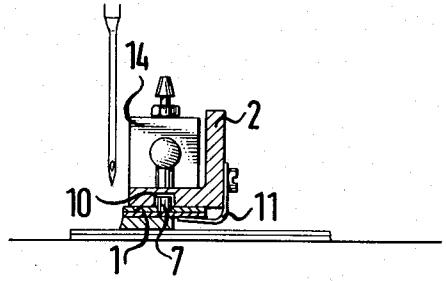
FIG. 5 is a cross-sectional view of the guide rail of FIG. 1, taken along the section line A-B.

FIGS. 1 and 5 show a guide rail 2 according to a first embodiment of the invention, which is connected displaceably in a known manner to a sewing machine, for instance an automatic long seamer, for defining the instance an automatic long seamer, for defining the desired course of a seam. The workpiece is placed on the work table and displaced by the guide rail 2, and is thus moved past the stitch-formation point of the sewing machine. The bottom 1 of the guide rail 2 has a groove 10 which extends parallel to its longitudinal edges.

Figure 6:
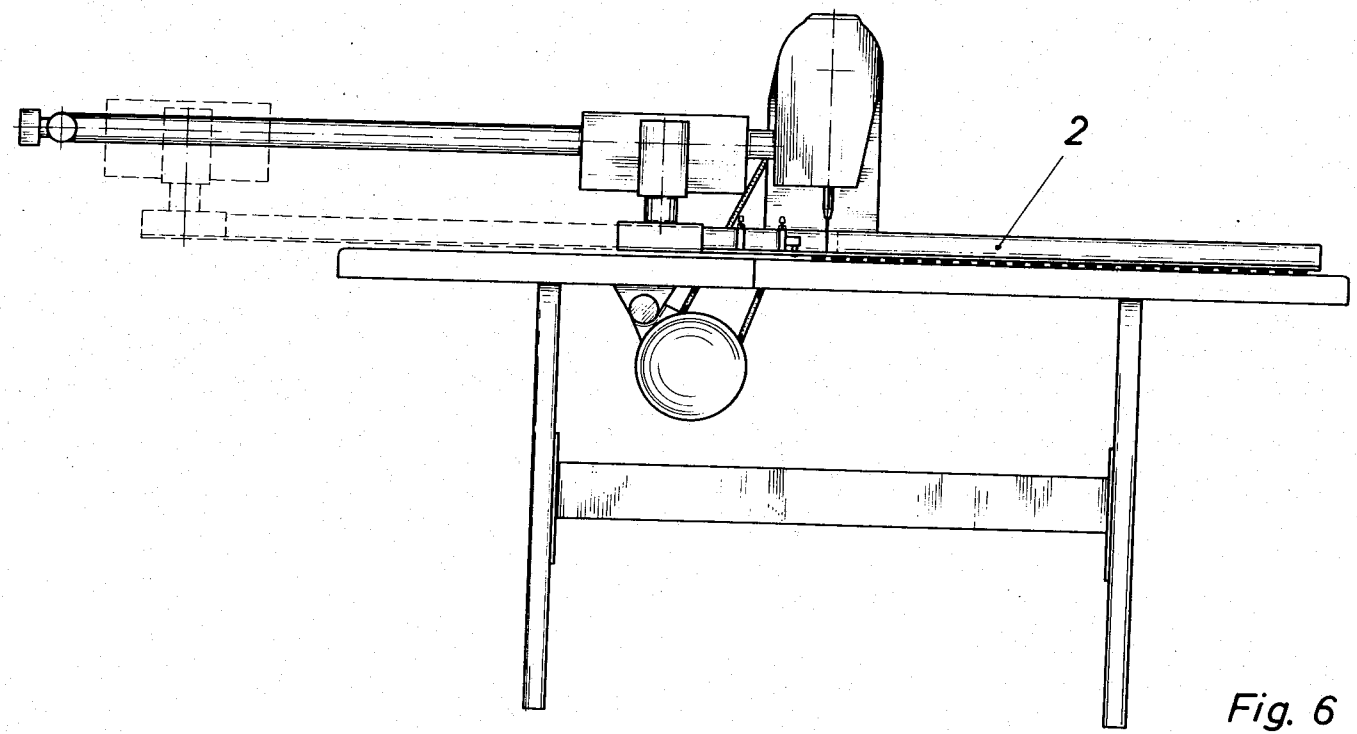
FIG. 6 is an elevational view of a sewing machine equipped with a guide rail according to any of the previous embodiments, showing the guide rail in its forward position.

FIG. 6 is an elevational view of a sewing machine equipped with a guide rail 2 according to an embodiment of the invention. As seen therein, the guide rail reciprocates between two extreme positions. The position in solid lines at the right of FIG. 6 is occupied by the guide rail prior to a sewing operation and will be referred to as the "forward" position. The position at the left of FIG. 6 shown in phantom will be referred to herein as the "rearward" position. As the guide rail moves from the forward position to the rearward position, the entire workpiece is moved past the stitch-formation point of the sewing machine.

A sewing-material stretching device 3 on the bottom 1 comprises a plurality of holding elements 4 arranged in an overlapping manner one behind the other. Each of the holding elements 4 has two arms 5, 6, which are separated by an offset so that the respective surfaces of the arms 5, 6 define distinct, substantially parallel planes. The distance between the respective top surfaces of the arms 5, 6 advantageously corresponds to the thickness of the material of the arm 5.

Figure 2:
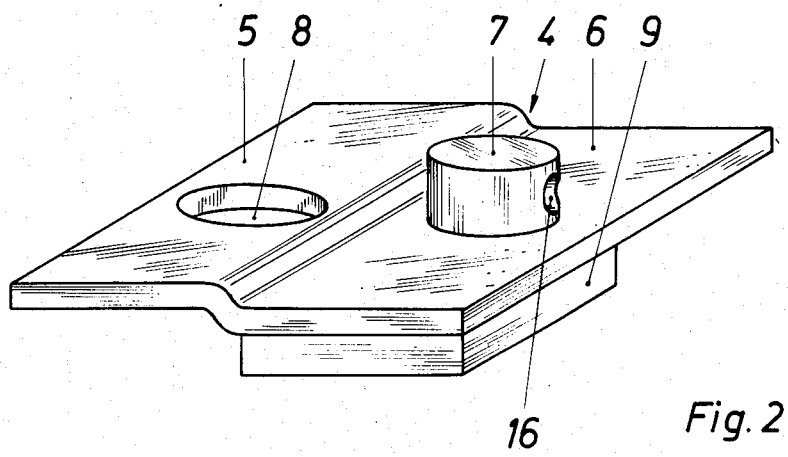
FIG. 2 is a perspective view of one of the holding elements with an offset as in FIG. 1.

On the top of the arm 6 there is provided, as shown in FIG. 2, a pin 7 which is firmly attached to the holding element 4 in a known manner by riveting, soldering or cementing, for example. The width of the groove 10 is such that it receives the pins 7 which are freely movable within it.

Figure 3:
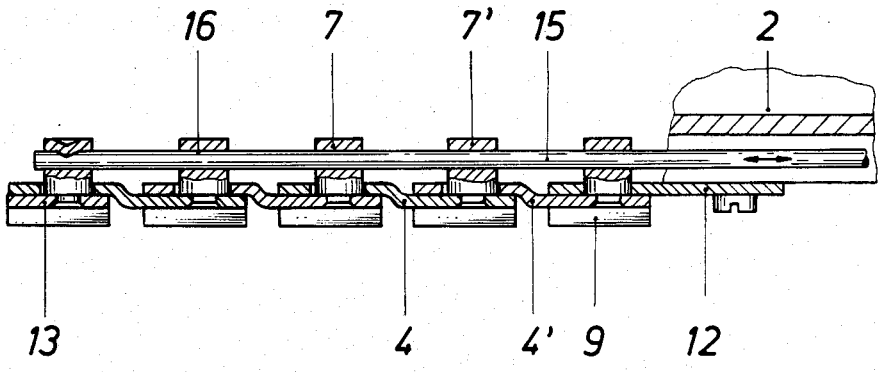
FIG. 3 is a cross-sectional view of a chain of holding elements for a sewing-material stretching device according to a second embodiment of the invention, also including offset holding elements.

Within the arm 5 of the holding element 4 is a hole 8, which receives the pin 7' of an adjacent holding element 4' (see generally FIG. 3). The hole 8 is so dimensioned that the pin 7' can move back and forth sufficiently within the hole 8 in the longitudinal direction of the holding elements 4 and 4'.

A piece of elastic material 9 having a rough surface is firmly connected to the bottom of the arm 6. Alternatively, the holding element 4 could be provided with sufficient skid resistance by providing the bottom of the arm 6, for example, either with raised fluting or with protruding conical or pyramidal points.

By inserting the pin 7' of the adjacent holding element 4' into the hole 8, there is produced a chain of variable length consisting of a plurality of holding elements 4, all of the pins 7 of said elements being received by the groove 10. Said chain is connected in form-locked manner to the guide rail 2 by a plurality of angle members 11. The vertical arm of each of said angle members is firmly attached, as shown in FIG. 5, to the guide rail 2 while its other arm partially covers the bottom of the arm 6. In this way, the holding elements 4, which are arranged in overlapping manner one behind the other, are prevented from dropping out of the groove 10.

Referring now to FIG. 3, in a second embodiment of the holding elements 4, each pin 7 has, extending through it, a hole 16 arranged in the longitudinal direction of the holding element 4, through which hole a spring-steel wire 15 is inserted. In this way, a flexible chain-like connection of all holding elements 4 is made possible. One end member 12 of this chain is firmly attached to the guide rail 2, while an actuator 14 (see FIG. 1) pulls the holding elements 4 apart by acting on the spring-steel wire 15, which is attached to the opposite end member 13, as indicated by the arrow. A suitable actuator 14 may be a single-acting or double-acting cylinder, actuated by pressure fluid (compressed air in the embodiment of FIG. 1), which is attached to the guide rail 2. The movable piston rod of the actuator 14 either acts directly on the end member 13 or acts indirectly on the end member 13 via the spring-steel wire 15.

The actuator 14 may also take the form of a one-directional device such as a solenoid which draws the holding elements 4 apart against the force of a spring. Such solenoid may act directly on the end member 13, or preferably may act indirectly via the spring-steel wire 15 that extends through the pins 7.

Figure 4:
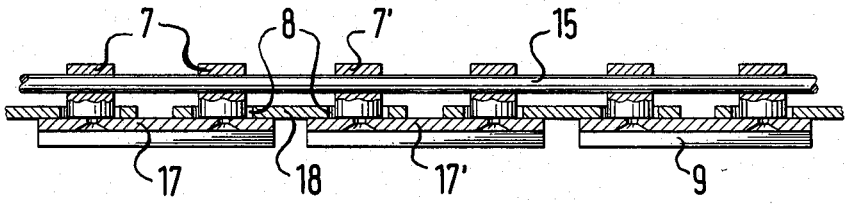
FIG. 4 is a cross-sectional view of a chain of holding elements for a sewing-material stretching device according to a third embodiment of the invention, which has flat holding elements.

FIG. 4 shows a third embodiment of the invention, in which the sewing-material stretching device 3 comprises flat holding elements 17 arranged in a row one behind the other, each of them having two pins 7. Between every two adjacent holding elements 17, 17' there is provided a strap 18 in which there are two holes 8. By the arrangement of the holding elements 17 and the straps 18 one behind the other, a chain of variable length is produced which, as in the previous embodiments, is attached in form-locked manner to the guide rail 2 by the groove 10 and at least one angle member 11.

The manner of operation of a guide rail 2 according to any of the preceding embodiments, having the sewing-material stretching device 3 mounted beneath it, will now be described.

A multi-layer workpiece is first placed in proper position on the work table at a receiving station adjacent to the stitch-formation point, and the guide rail 2 which is in its forward position is then moved downward until its bottom 1 presses flat against the workpiece. In this way, the workpiece is held between a slide plate, which is firmly attached to the work tabletop and has a very smooth surface, and the guide rail 2. By the action of pressure fluid on the actuator 14, the holding elements 4 or 17 of the sewing-material stretching device 3 are pulled apart a predetermined amount. In this way, the workpiece is stretched by the rough bottom surfaces of the holding elements 4 or 17. The guide rail 2 is now moved rearward by conventional means toward and past the stitch-formation point of the sewing machine for sewing of the stretched workpiece. After completion of the sewing process, the guide rail 2 is raised and moved back to the receiving station. During the return movement, the actuator 14 is evacuated so that the holding elements 4 or 17 again move together.

After the lifting of the guide rail 2 and evacuation of the actuator 14, the multi-layer workpiece contracts to its original length. In this way it is possible to make stitches which are slightly loosely formed, and thus tension wrinkles, which occur particularly often when sewing thin sewing material, are prevented. Of course, the invention is useful in sewing other types of material as well.

Although illustrative embodiments of the invention have been described herein, it is to be understood that the invention is not limited to such embodiments. Rather, modifications and variations of the invention may occur to one skilled in the art within the scope of the invention, as defined in the claims.

What is claimed is:

1. A workpiece guide rail for a sewing machine for guiding a workpiece past a stitch formation point, comprising:

a frame;

a plurality of holding elements movably mounted on the bottom of the frame, each holding element having a bottom surface adapted for gripping the workpiece; and means for temporarily increasing a spacing between the holding elements by a predetermined amount to stretch the workpiece, and decreasing the spacing between the holding elements to their previous spacing to allow the workpiece to return to its previous dimensions.

2. A guide rail as in claim 1, further comprising means for interlinking the holding elements; and means for retaining each holding element movably mounted on the frame as aforesaid.

3. A guide rail as in claim 2, wherein said interlinking means comprises a male connector and a female connector on a given holding element, the male connector of said given holding element engaging a female connector of an adjacent holding element, for interlinking said holding elements.

4. A guide rail as in claim 3, wherein said engaging male and female connectors are on respective portions of said adjacent holding elements which overlap.

5. A guide rail as in claim 4, wherein the male connector includes a pin on a first arm of a holding element; and the female connector includes a hole in a second arm of said holding element which is integral with said first arm;

the two arms being offset from one another and substantially parallel for providing said overlap between a first arm of the given holding element and a second arm of the adjacent holding element.

6. A guide rail as in claim 5, wherein the engaging male and female connectors are engaged so as to be mutually displaceable for permitting a spacing between adjacent holding elements to be increased and decreased as aforesaid.

7. A guide rail as in claim 6, wherein a groove is defined in the bottom of the frame, each pin of each holding element being received in said groove for providing said movable mounting of said holding elements; and said retaining means comprises at least one angle member, said angle member having an upper portion fixed to the frame and a lower portion engaging at least one holding element for retaining it in said movable mounting.

8. A guide rail as in claim 7, wherein said interlinking of said holding elements forms a chain, a first end of said chain being fixed to said frame, and a second end of said chain being adapted for being acted upon by an actuator for temporarily increasing a spacing between the holding elements as aforesaid.

9. A guide rail as in claim 8, further comprising an actuator on said frame which includes a pressure cylinder, the cylinder having a piston rod for acting upon said second end of said chain.

10. A guide rail as in claim 8, further comprising an actuator on said frame which includes a solenoid, the solenoid comprising an armature for acting upon said second end of said chain.

11. A guide rail as in claim 2, wherein said interlinking means comprises a pair of male connectors on each of two given adjacent holding elements, and a female connector for engaging the male connectors on each of said two holding elements, for interlinking said holding elements.

12. A guide rail as in claim 11, wherein said holding elements are substantially flat, each said male connector including a pin on a surface of said holding element, and each said female connector including a strap having two holes for engaging one respective pin on each of a pair of adjacent holding elements.

13. A guide rail as in claim 12, wherein said male and female connectors are engaged so as to be mutually displaceable for permitting a spacing between adjacent holding elements to be increased and decreased as aforesaid.

14. A guide rail as in claim 1, wherein said bottom surface of each holding element includes resilient material having a surface adapted for gripping said workpiece.

15. A guide rail as in claim 1, wherein said bottom surface of each holding element includes raised fluting for gripping said workpiece.

16. A guide rail as in claim 1, wherein said bottom surface of each holding element includes a plurality of projections for gripping said workpiece.

17. A guide rail as in claim 16, wherein said projections are generally conical.

18. A guide rail as in claim 16, wherein said projections are generally pyramidal.

* * * * *